US010005281B2

(12) United States Patent
Yoshida et al.

(10) Patent No.: US 10,005,281 B2
(45) Date of Patent: Jun. 26, 2018

(54) LIQUID EJECTION HEAD, LIQUID EJECTION UNIT, AND APPARATUS FOR EJECTING LIQUID

(71) Applicants: Takahiro Yoshida, Ibaraki (JP); Tomohiko Kohda, Ibaraki (JP); Takeshi Shimizu, Kanagawa (JP); Kanshi Abe, Ibaraki (JP); Ryo Kasahara, Kanagawa (JP); Takayuki Nakai, Kanagawa (JP); Shiomi Andou, Kanagawa (JP)

(72) Inventors: Takahiro Yoshida, Ibaraki (JP); Tomohiko Kohda, Ibaraki (JP); Takeshi Shimizu, Kanagawa (JP); Kanshi Abe, Ibaraki (JP); Ryo Kasahara, Kanagawa (JP); Takayuki Nakai, Kanagawa (JP); Shiomi Andou, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 7 days.

(21) Appl. No.: 14/976,757

(22) Filed: Dec. 21, 2015

(65) Prior Publication Data

US 2016/0185113 A1 Jun. 30, 2016

(30) Foreign Application Priority Data

Dec. 27, 2014 (JP) ..... 2014-266869

(51) Int. Cl.
*B41J 2/14* (2006.01)

(52) U.S. Cl.
CPC ..... *B41J 2/1433* (2013.01); *B41J 2/14201* (2013.01); *B41J 2/14233* (2013.01);
(Continued)

(58) Field of Classification Search
CPC ..... B41J 2/14233; B41J 2002/14306; B41J 2/1433
See application file for complete search history.

(56) References Cited

U.S. PATENT DOCUMENTS 8,632,165 B2 1/2014 Akahane et al.
8,899,724 B2 12/2014 Akahane et al.
(Continued)

FOREIGN PATENT DOCUMENTS

JP 2012-143948 8/2012
JP 2012-143980 8/2012
JP 2015-071289 4/2015

*Primary Examiner* — Kristal Feggins
*Assistant Examiner* — Kendrick Liu
(74) *Attorney, Agent, or Firm* — Cooper & Dunham LLP

(57) ABSTRACT

A liquid ejection head is provided. The liquid ejection head includes at least two nozzle lines configured to have a plurality of nozzles for ejecting liquid disposed in respective lines, a plurality of individual liquid chambers configured to be in communication with corresponding nozzles of the nozzle lines, and at least two circulation channels corresponding to the nozzle lines, configured to be in communication with the individual liquid chambers. The at least two circulation channels are in communication with each other through a bridging channel disposed in a direction intersecting with the nozzle line direction, and the bridging channel and the circulation channels are disposed at different positions in a thickness direction of a member which forms the bridging channel and the circulation channels.

17 Claims, 12 Drawing Sheets

(52) U.S. Cl.
CPC ..... *B41J 2002/14362* (2013.01); *B41J 2002/14387* (2013.01); *B41J 2002/14419* (2013.01); *B41J 2202/12* (2013.01)

(56) References Cited

U.S. PATENT DOCUMENTS

| | | | | |
|---|---|---|---|---|
| 9,096,061 | B2 | 8/2015 | Sasaki | |
| 2005/0036007 | A1* | 2/2005 | Watanabe | B41J 2/14209 347/68 |
| 2008/0143793 | A1* | 6/2008 | Okuda | B41J 2/14233 347/68 |
| 2011/0069118 | A1* | 3/2011 | Ohzeki | B41J 2/14233 347/44 |
| 2015/0306875 | A1 | 10/2015 | Nishimura et al. | |

* cited by examiner

LIQUID EJECTION HEAD, LIQUID EJECTION UNIT, AND APPARATUS FOR EJECTING LIQUID

BACKGROUND OF THE INVENTION

1. Field of the Invention

The present invention relates to a liquid ejection head, a liquid ejection unit, and an apparatus for ejecting liquid.

2. Description of the Related Art

As a liquid ejection head (a droplet ejection head) for ejecting liquid, a circulation head is known in which liquid in a plurality of individual liquid chambers is circulated.

For example, a head is known in which each of circulation channels is provided independently for a corresponding one of two lines (nozzle lines) of pressure-generating chambers, in a direction of the nozzle lines, each of the circulation channels being in communication with communication channels through which the pressure-generating chambers are in communication with corresponding nozzles, and thus, liquid of different colors is ejected from corresponding nozzle lines (Patent Document 1).

Here, when a single circulation channel is provided between the lines of individual liquid chambers (pressure-generating chambers) in order to eject the same kind of liquid from the two nozzle lines, the size of the head in the width direction (a direction orthogonal to the nozzle line direction) becomes larger.

On the other hand, as shown in Patent Document 1, in the case where, for example, two circulation channels are provided for each nozzle line, it is necessary to provide circulation ports for corresponding circulation channels, which results in a problem of a complicated configuration.

The present invention has been made in view of the above problems, and it is an object to share a plurality of circulation channels with a simple configuration while securing the rigidity of a channel member.

CITATION LIST

Patent Document

[Patent Document 1] Japanese Laid-Open Patent Application No. 2012-143948

SUMMARY OF THE INVENTION

To solve the above problems, a liquid ejection head of an embodiment of the present invention includes at least two nozzle lines configured to have a plurality of nozzles for ejecting liquid disposed in respective lines, a plurality of individual liquid chambers configured to be in communication with corresponding nozzles of the nozzle lines, at least two circulation channels corresponding to the nozzle lines, configured to be in communication with the individual liquid chambers. The at least two circulation channels are in communication with each other through a bridging channel disposed in a direction intersecting the nozzle line direction, and the bridging channel and the circulation channels are disposed at different positions in a thickness direction of a member which forms the bridging channel and the circulation channels.

According to the embodiment of the present invention, a plurality of circulation channels can be shared by a simple configuration while securing the rigidity of the channel member.

Other objects, features and advantages of the present invention will become more apparent from the following detailed description when read in conjunction with the accompanying drawings.

DETAILED DESCRIPTION OF THE PREFERRED EMBODIMENTS

Figure 1:
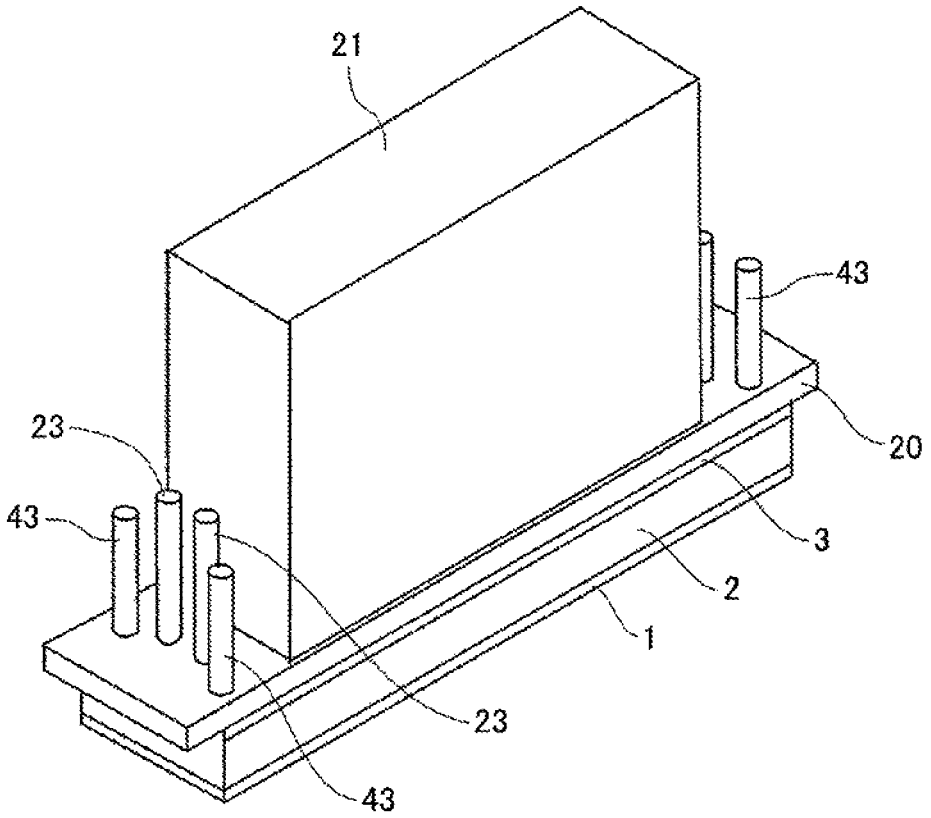
FIG. 1 is an external perspective view of an example of a liquid ejection head according to an embodiment of the present invention.
Figure 2:
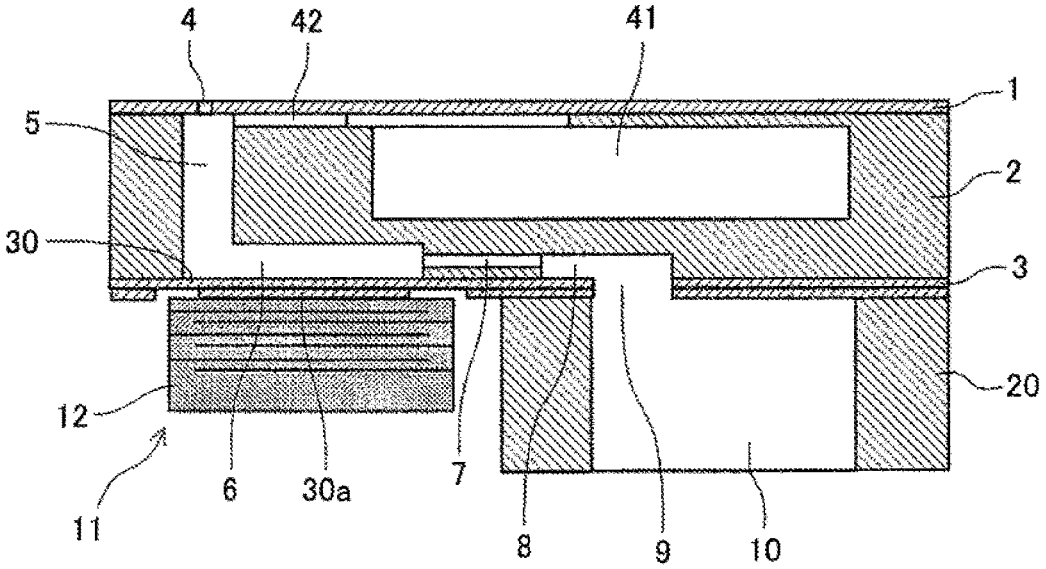
FIG. 2 is a cross-sectional view of the liquid ejection head in a direction (longitudinal direction of a liquid chamber) orthogonal to a nozzle line direction.
Figure 3:
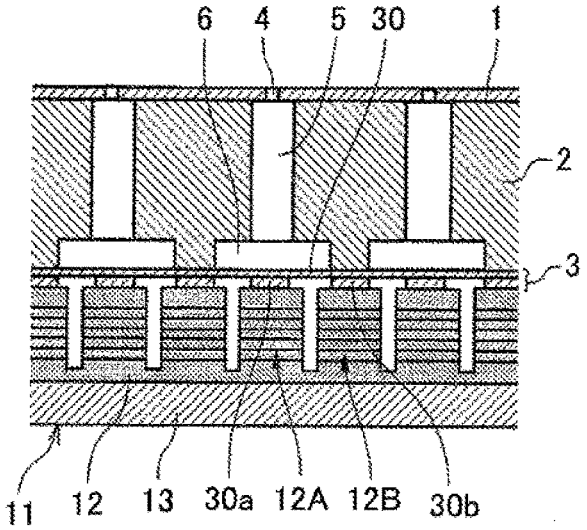
FIG. 3 is another cross-sectional view of the liquid ejection head in a direction (longitudinal direction of a nozzle line) parallel to a nozzle line direction.

In the following, embodiments of the present invention will be described referring to the accompanying drawings. An example of a liquid ejection head according to the present embodiment will be described referring to FIG. 1 through FIG. 3. FIG. 1 is an external perspective view of an example of a liquid ejection head according to an embodiment of the present invention. FIG. 2 is a cross-sectional view of the liquid ejection head in a direction (longitudinal direction of a liquid chamber) orthogonal to a nozzle line direction. FIG. 3 is another cross-sectional view of the liquid ejection head in a direction (longitudinal direction of a nozzle line) parallel to a nozzle line direction. It should be noted that the ejection direction is a downward direction in FIG. 1 while the ejection direction is an upward direction in FIGS. 2 and 3.

The liquid ejection head includes a nozzle plate 1, a channel plate 2, and a diaphragm member 3 as a wall surface member, which are joined as layers. Further, the liquid ejection head includes a piezoelectric actuator 11 for changing a displacement of the diaphragm member 3, a frame member 20 as a common liquid chamber member, and a cover 21.

The nozzle plate 1 includes a plurality of nozzles 4 for ejecting liquid.

In the channel plate 2, there are through holes and groove portions which form a channel 5 communicating with the nozzle 4, an individual liquid chamber 6 communicating with the channel 5, a fluid resistance portion 7 communicating with the individual liquid chamber 6, and a liquid introduction portion (channel) 8 communicating with the fluid resistance portion 7.

The diaphragm member 3 includes an opening 9 which connects the liquid introduction portion 8 with a common liquid chamber 10 formed in the frame member 20.

The diaphragm member 3 is a wall surface member which forms a wall surface of the individual liquid chamber 6 of the channel plate 2. The diaphragm member 3 has a two-layer structure including the first layer from the side of the channel plate 2, which forms a thin-walled portion, and the second layer which forms a thick-walled portion. A deformable diaphragm area 30 is formed in a portion of the first layer corresponding to the individual liquid chamber 6.

Further, on the opposite side of the diaphragm member 3 with respect to the individual liquid chamber 6, the piezoelectric actuator 11 is disposed, which includes an electromechanical conversion element as a driving means (an actuator means or a pressure generating means) for deforming the diaphragm area 30 of the diaphragm member 3.

The piezoelectric actuator 11 includes a piezoelectric member 12 joined onto a base member 13. Grooving by half-cut dicing is applied to the piezoelectric member 12, and a required number of pillar-shaped piezoelectric elements (piezoelectric pillar) 12A and 12B are formed for one piezoelectric member 12. The pillar-shaped piezoelectric elements 12A and 12B are disposed like the teeth of a comb at a predetermined interval.

Here, the piezoelectric elements 12A of the piezoelectric member 12 are piezoelectric elements driven by having a drive waveform applied, and the piezoelectric elements 12B of the piezoelectric member 12 are simply used as props without having a drive waveform applied. All of the piezoelectric elements 12A and 12B may be used as piezoelectric elements driven by having a drive waveform applied.

Further, the piezoelectric elements 12A are joined to respective convex portions 30*a* which are island-like thick portions formed in the diaphragm area 30 of the diaphragm member 3. Further, the piezoelectric elements 12B are joined to respective convex portions 30*b* which are thick portions of the diaphragm member 3.

In the piezoelectric member 12, piezoelectric layers and internal electrodes are alternately disposed to form layers. The internal electrodes are drawn to external electrodes in an end surface.

In the frame member 20, the common liquid chamber 10 is formed. Liquid is supplied to the common liquid chamber 10 from a supplying-and-circulating mechanism.

Further, in the channel plate 2, a circulation channel 41 which is in communication with the individual liquid chambers 6 is formed in a side of the nozzle plate 1, which side is opposite to the individual liquid chamber 6, and a groove portion is formed which serves as a circulation resistance portion 42 which connects the circulation channel 41 with the channel 5.

Further, in the frame member 20, there are a supplying port 23 which is in communication with the common liquid chamber 10 and a circulation port (discharging port) 43 which is in communication with the circulation channel 41.

In the liquid ejection head described above, for example, by having a voltage applied to the piezoelectric element 12A lower than a reference voltage, the piezoelectric element 12A contracts, the diaphragm area 30 of the diaphragm member 3 is lowered, volume of the individual liquid chamber 6 is increased, and liquid flows into the individual liquid chamber 6.

Afterwards, by increasing the voltage applied to the piezoelectric element 12A, the piezoelectric element 12A expands in the layer direction, the diaphragm area 30 of the diaphragm member 3 is deformed in a direction heading for the nozzle 4, the volume of the individual liquid chamber 6 is decreased, the liquid in the individual liquid chamber 6 is pressurized, and the liquid is ejected from the nozzle 4.

Afterwards, by putting the voltage applied to the piezoelectric element 12A back to the reference voltage, the diaphragm area 30 of the diaphragm member 3 is restored to its original position, the volume of the individual liquid chamber 6 is increased, a negative pressure is generated, and then, the individual liquid chamber 6 is filled with the liquid from the common liquid chamber 10. There, after vibration of the meniscus surface of the nozzle 4 is attenuated and stabilized, operations for the next ejection are started.

It should be noted that the method of driving the head is not limited to the above example (pull-push ejection method) but, depending on the way the drive waveform is applied, a pull ejection method or a push ejection method may be used.

Figure 4:
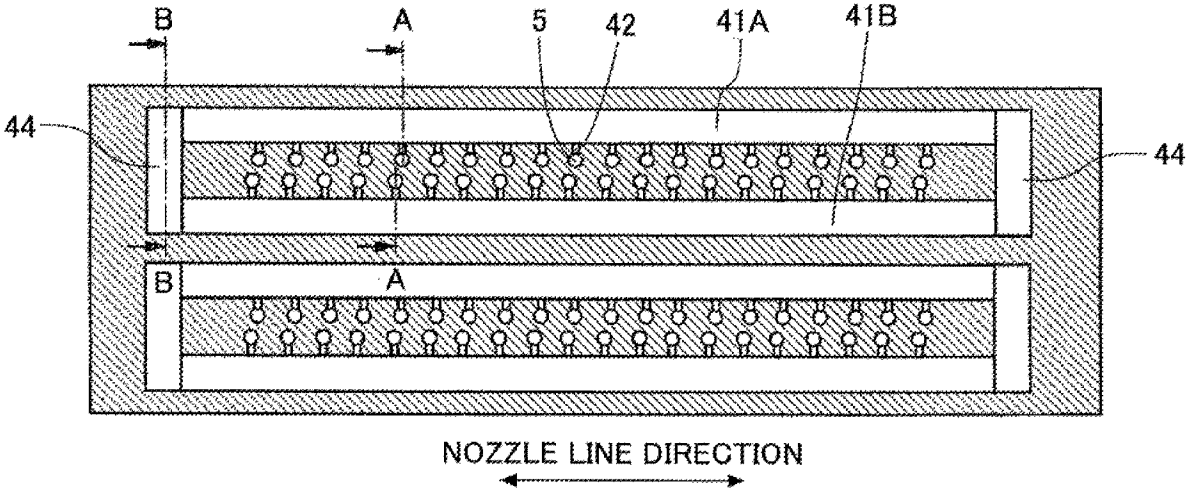
FIG. 4 is a cross-sectional view corresponding to a C-C line in FIG. 5 which serves as an illustration of a first embodiment of the present invention.
Figure 5:
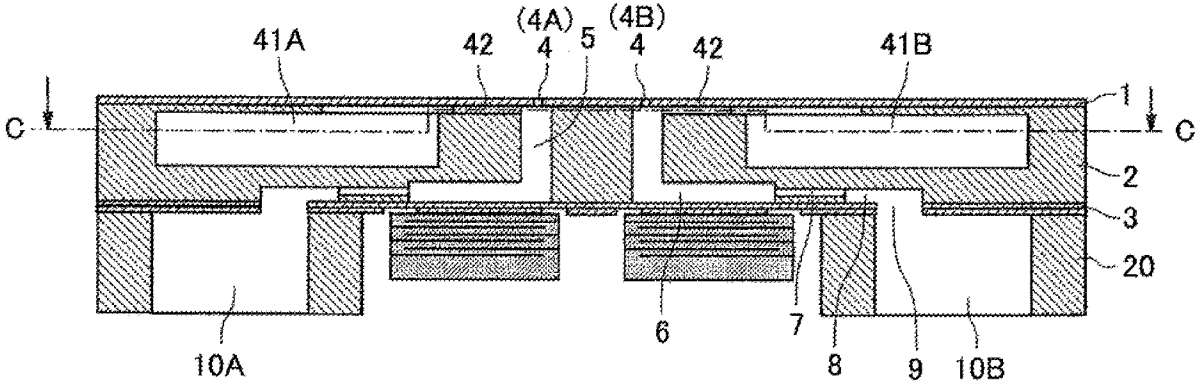
FIG. 5 is a cross-sectional view corresponding to an A-A line in FIG. 4 which serves as an illustration of the first embodiment of the present invention.
Figure 6:
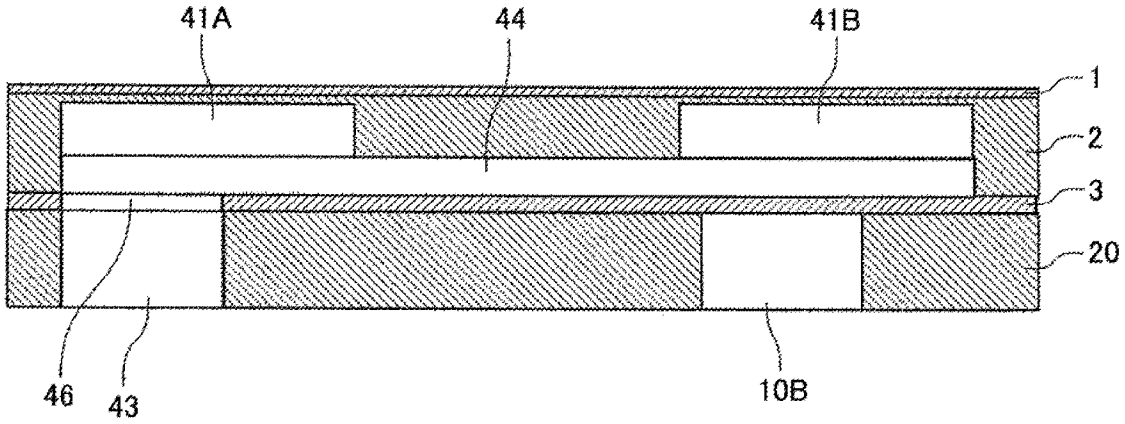
FIG. 6 is a cross-sectional view corresponding to a B-B line in FIG. 4 which serves as an illustration of the first embodiment of the present invention.
Figure 7:
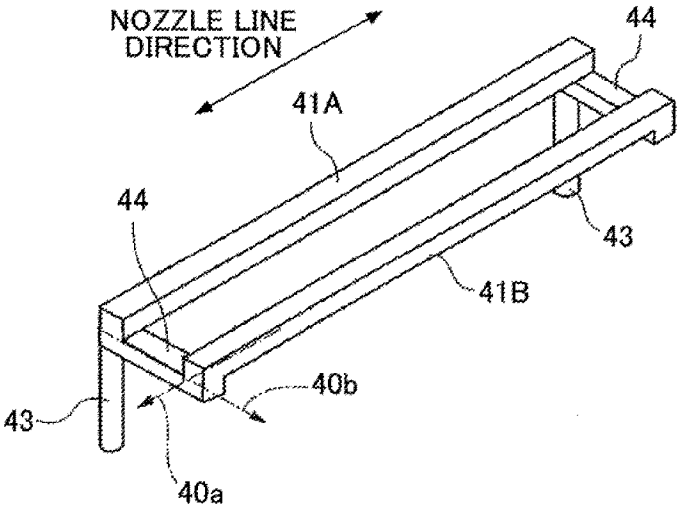
FIG. 7 is a schematic perspective view of a portion of a circulation channel which serves as an illustration of the first embodiment of the present invention.

Next, the first embodiment of the present invention will be described referring to FIG. 4 through FIG. 7. FIG. 4 is a cross-sectional view corresponding to a C-C line in FIG. 5 which serves as an illustration of the first embodiment of the present invention. FIG. 5 is a cross-sectional view corresponding to an A-A line in FIG. 4 which serves as an illustration of the first embodiment of the present invention. FIG. 6 is a cross-sectional view corresponding to a B-B line in FIG. 4 which serves as an illustration of the first embodiment of the present invention. FIG. 7 is a schematic perspective view of a portion of a circulation channel which serves as an illustration of the first embodiment of the present invention.

In the present embodiment, the nozzle plate 1 includes four nozzle lines which are two sets of two nozzle lines 4A and 4B including a plurality of nozzles 4 (the same as the second embodiment which will be described later referring to FIG. 9).

Further, in the channel plate 2, in the side of the nozzle plate 1 which is opposite to the individual liquid chamber 6, there are two circulation channels 41A and 41B (referred to as "circulation channels 41" as described above when 41A and 41B are not distinguished) corresponding to the two nozzle lines 4A and 4B, which circulation channels 41A and 41B are in communication with the corresponding channels 5 and the individual liquid chambers 6 through the circulation resistance portions 42. It should be noted that, although there are two sets of two circulation channels 41A and 41B, in order to make a simple description, only one set of two circulation channels 41A and 41B will be described.

Further, the two circulation channels 41A and 41B are in communication with each other through bridging channels 44 and 44 which are formed at respective ends of the channel plate 2 in the nozzle line direction, and which are formed in a direction intersecting the nozzle line direction.

Here, as shown in FIG. 6 and FIG. 7, bridging channels 44 and the circulation channels 41 are disposed at different positions in the thickness direction of the channel plate 2 which is a member forming the bridging channels 44 and the circulation channels 41, and the bridging channels 44 and the circulation channels 41 are connected to each other at the ends of the bridging channels 44 and the circulation channels 41.

Specifically, as shown in FIG. 7, a central axis 40*a* of a cross-section of the circulation channel 41 and a central axis 40*b* of a cross-section of the bridging channel 44 are crossing three-dimensionally, the central axis 40*a* going through the center of the cross-section (channel cross-section) of the circulation channel 41 in a direction orthogonal to the longitudinal direction (nozzle line direction) of the circulation channel 41, and the central axis 40*b* going through the center of the cross-section (channel cross-section) of the bridging channel 44 in a direction orthogonal to the longitudinal direction (a direction intersecting the circulation channel 41) of the bridging channel 44.

Further, at both ends in the nozzle line direction, there are the circulation ports 43 which are in communication with the circulation channel 41 through the bridging channels 44. Here, the circulation channels 41A and 41B are in communication with each other through the bridging channels 44. Therefore, the circulation channels 41A and 41B share the circulation ports 43 in a direction orthogonal to the nozzle line direction.

It should be noted that there are two sets of two nozzle lines in FIG. 1. Therefore, at one end in the nozzle line direction, there are two circulation ports 43 in a direction orthogonal to the nozzle line direction.

Further, the circulation ports 43 are in communication with the bridging channels 44 through openings 46 formed in the diaphragm member 3.

With the configuration described above, the liquid supplied from the common liquid chamber 10 to the individual liquid chamber 6 flows into the circulation channels 41 through the circulation resistance portions 42, and, from the circulation channels 41, the liquid is ejected to the circulation port 43 of the frame member 20 through the opening 46 of the diaphragm member 3.

Here, by making the circulation channels 41A and 41B be in communication with each other through the bridging channels 44, with a simple configuration, the circulation channels 41A and 41B can be shared, and the circulation ports 43 can be shared by the circulation channels 41A and 41B.

Further, by making the bridging channels 44 and the circulation channels 41 be disposed at different positions in the thickness direction of the channel plate 2, the rigidity degradation of the channel plate 2 due to the bridging channels 44 can be reduced and the rigidity of the head can be secured.

In other words, it is preferable to make the channel cross-sectional area of the circulation channels 41 larger in order to reduce the pressure loss gap which occurs among the individual liquid chambers 6 when the liquid is circulated in the circulation channels 41. At this time, if the bridging channels 44 connecting the two circulation channels 41 are disposed at the same position as the circulation channels 41 in the thickness direction of the channel plate 2, then the rigidity of the channel plate 2 will be degraded.

Here, the channel cross-sectional area of the bridging channels 44 connecting the two circulation channels 41A and 41B does not contribute to the pressure loss gap among the individual liquid chambers 6.

Therefore, two circulation channels 41 and the bridging channels 44 are disposed at different positions in the thickness direction of the channel plate 2. In other words, in the present embodiment, the center axis 40*b* of the bridging channel 44 and the center axis 40*a* of the circulation channel 41 are crossing three-dimensionally.

With the above arrangement, it becomes possible to secure the rigidity of the channel parts (channel plate and channel member) while making the cross-sectional area of the circulation channel larger.

Figure 8:
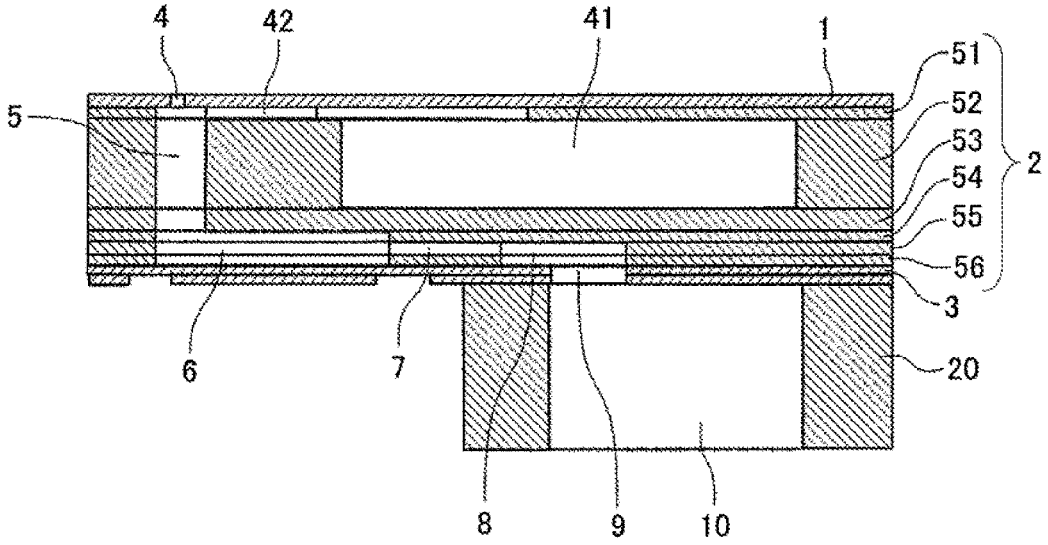
FIG. 8 is a cross-sectional view of a main section which serves as an illustration of a second embodiment of the present invention.
Figure 10:
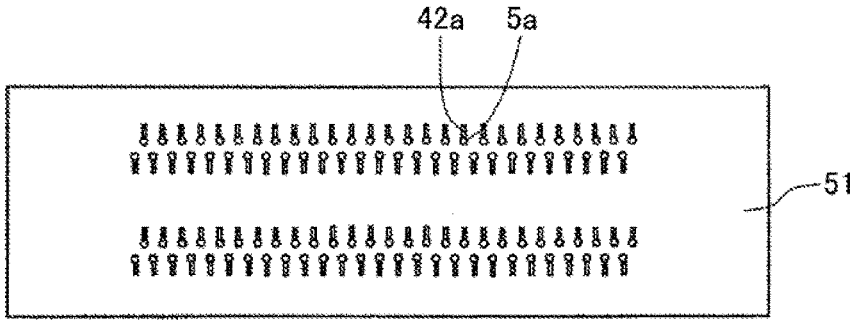
FIG. 10 is a plan view of a first channel plate which serves as an illustration of the second embodiment of the present invention.
Figure 11:
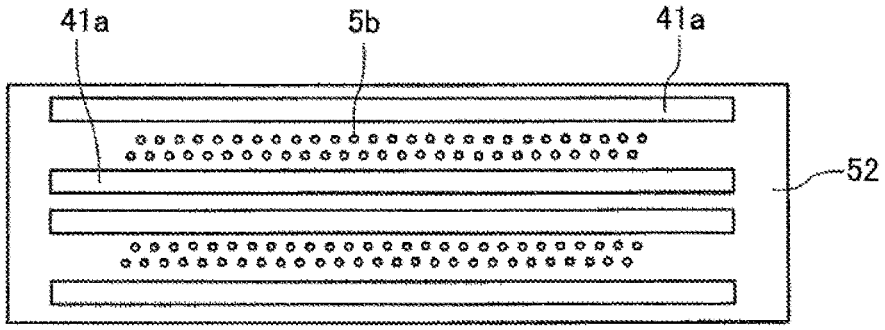
FIG. 11 is a plan view of a second channel plate which serves as an illustration of the second embodiment of the present invention.
Figure 12:
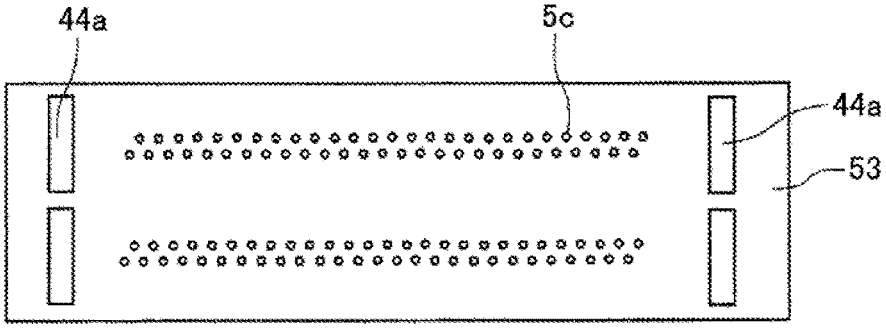
FIG. 12 is a plan view of a third channel plate which serves as an illustration of the second embodiment of the present invention.
Figure 13:
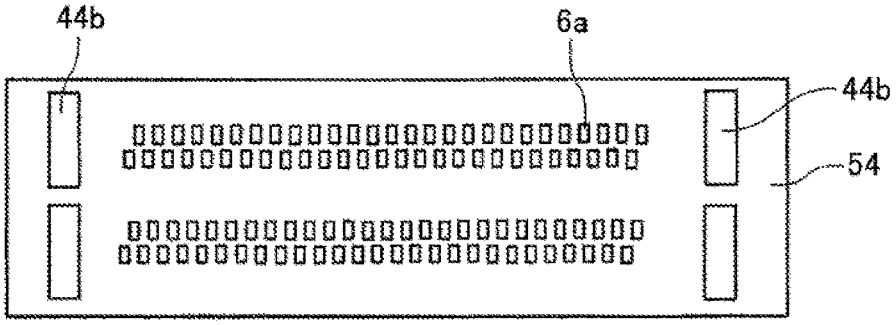
FIG. 13 is a plan view of a fourth channel plate which serves as an illustration of the second embodiment of the present invention.
Figure 14:
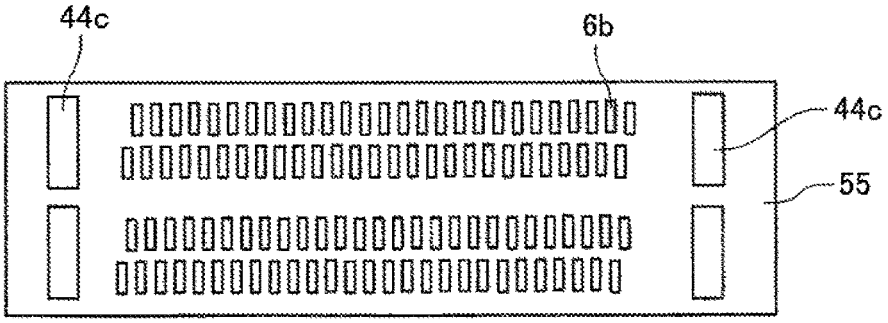
FIG. 14 is a plan view of a fifth channel plate which serves as an illustration of the second embodiment of the present invention.
Figure 15:
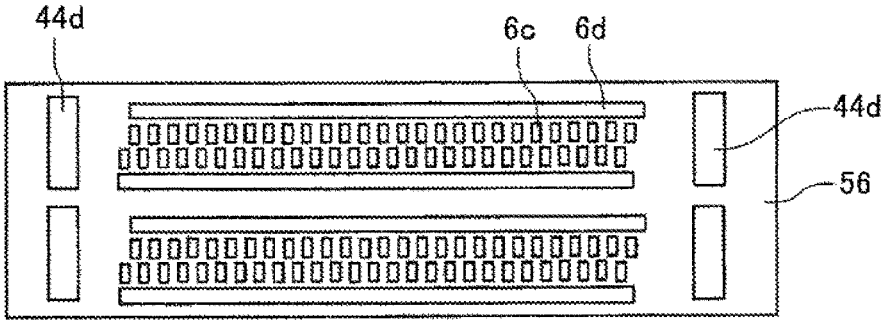
FIG. 15 is a plan view of a sixth channel plate which serves as an illustration of the second embodiment of the present invention.
Figure 16:
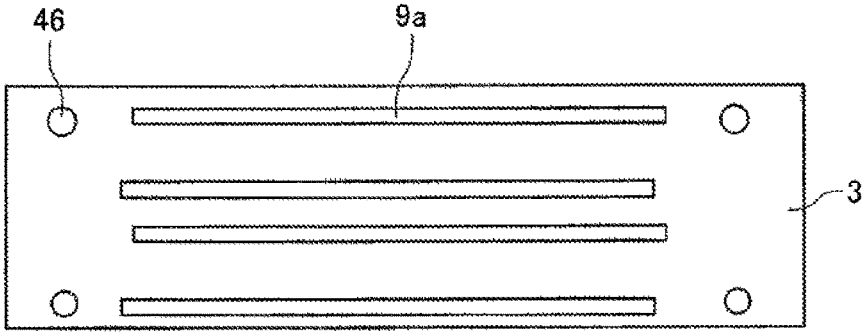
FIG. 16 is a plan view of a diaphragm member which serves as an illustration of the second embodiment of the present invention.
Figure 17:
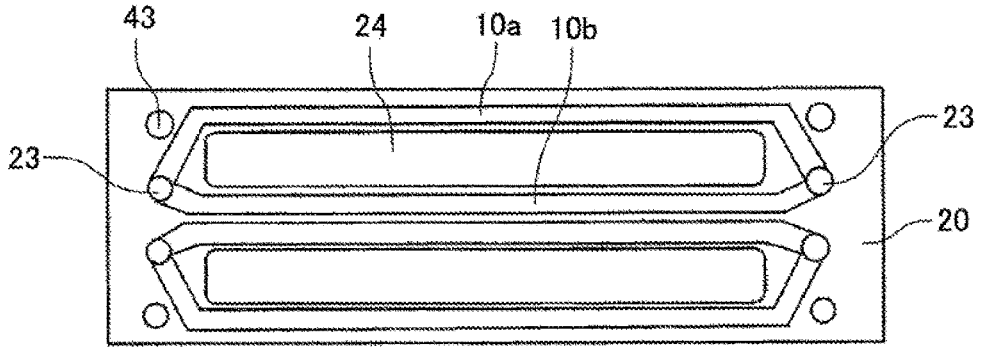
FIG. 17 is a plan view of a frame member which serves as an illustration of the second embodiment of the present invention.

Next, the second embodiment of the present invention will be described referring to FIG. 8 through FIG. 17. FIG. 8 is a cross-sectional view of a main section which serves as an illustration of the second embodiment of the present invention. FIG. 9 is a plan view of a nozzle plate which serves as an illustration of the second embodiment of the present invention. FIG. 10 is a plan view of a first channel plate which serves as an illustration of the second embodiment of the present invention. FIG. 11 is a plan view of a second channel plate which serves as an illustration of the second embodiment of the present invention. FIG. 12 is a plan view of a third channel plate which serves as an illustration of the second embodiment of the present invention. FIG. 13 is a plan view of a fourth channel plate which serves as an illustration of the second embodiment of the present invention. FIG. 14 is a plan view of a fifth channel plate which serves as an illustration of the second embodiment of the present invention. FIG. 15 is a plan view of a sixth channel plate which serves as an illustration of the second embodiment of the present invention. FIG. 16 is a plan view of a diaphragm member which serves as an illustration of the second embodiment of the present invention. FIG. 17 is a plan view of a frame member which serves as an illustration of the second embodiment of the present invention.

In the present embodiment, the channel plate 2 includes layers of six plate-like members (layer members) which are the first channel plate 51 through the sixth channel plate 56. Specifically, from the side of the nozzle plate 1, the first channel plate 51 through the sixth channel plate 56 are laminated in this order in the channel plate 2. The diaphragm member 3 is laminated onto the sixth channel plate 56, and further, the frame member 20 is laminated onto the diaphragm plate 3.

Figure 9:
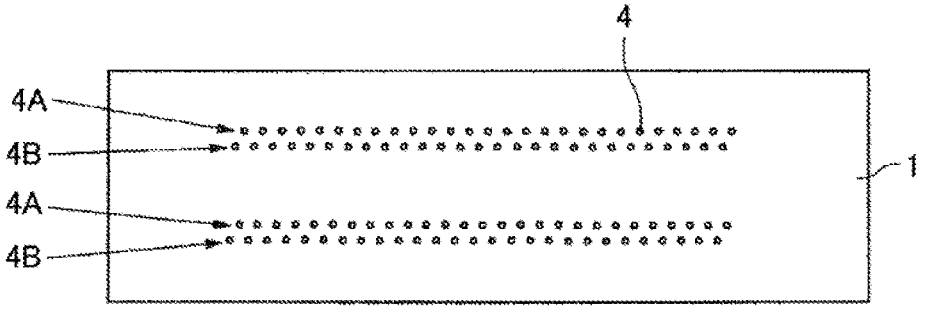
FIG. 9 is a plan view of a nozzle plate which serves as an illustration of the second embodiment of the present invention.

In the nozzle plate 1, as shown in FIG. 9, the nozzles 4 for ejecting liquid are included. Here, there are four nozzle lines including two sets of the nozzle lines 4A and 4B in which the nozzles 4 are disposed in respective lines.

In the first channel plate 51, as shown in FIG. 10, there are through holes 5*a* which form the channels 5 and through-groove portions 42*a* which form channels including the circulation resistance portions 42.

In the second channel plate 52, as shown in FIG. 11, there are through holes 5*b* which form the channels 5 and through-groove portions 41*a* which form the circulation channels 41.

In the third channel plate 53, as shown in FIG. 12, there are through holes 5*c* which form the channels 5 and through-groove portions 44*a* which form the bridging channels 44.

In the fourth channel plate 54, as shown in FIG. 13, there are through holes 6*a* which form the individual liquid chambers 6 and through-groove portions 44*b* which form the bridging channels 44.

In the fifth channel plate 55, as shown in FIG. 14, there are through holes 6*b* which form the individual liquid chambers 6, the fluid resistance portion 7 and the liquid introduction portion 8, and through-groove portions 44*c* which form the bridging channels 44.

In the sixth channel plate 56, as shown in FIG. 15, there are through holes 6*c* which form the individual liquid chambers 6, through holes 6*d* which form the liquid introduction portion 8, and through-groove portions 44*d* which form the bridging channels 44.

In the diaphragm member 3, as shown in FIG. 16, there are through-groove portions 9*a* which form the openings 9 and the openings 46 which are in communication with the respective circulation ports 43.

In the frame member 20, as shown in FIG. 17, there are two sets of concave portions 10*a* and 10*b* which form two common liquid chambers 10, the supplying ports 23 which are in communication with respective common liquid chambers 10A and 10B, and the circulation ports 43 which are in communication with the respective two circulation channels 41.

Further, the supplying ports 23 are disposed at both ends of the nozzle lines, and the liquid is supplied to two common liquid chambers 10 from respective sides.

Further, between the common liquid chambers 10A and 10B, there are through-groove portions 24 through which the piezoelectric actuator 11 is inserted.

As described above, by laminating a plurality of layer members (plate-like members) to form the circulation channels 41 and the bridging channels 44, the height of the circulation channels 41 can be secured with a simple configuration.

With the above configuration, the channel cross-sectional area of the circulation channel 41 can be made larger and the pressure loss can be reduced.

Further, by having the supplying ports 23 and the circulation ports 43 disposed at both ends of the nozzle lines, the supplying ports 23 and the circulation ports 43 can be disposed without making the outer shape of the head larger.

Further, in this case, the supplying ports 23 which are in communication with the common liquid chambers 10 supply the liquid from both sides of the common liquid chambers 10, and the bridging channels 44 which are in communication with the circulation channels 41A and 41B discharge the liquid from both sides of the circulation channels 41A and 41B.

As a result, compared to the case where the liquid is supplied and discharged from a single side, the pressure loss can be made one fourth, the size of the common liquid chambers and the size of the circulation channels can be made smaller, and the head can be downsized.

Figure 18:
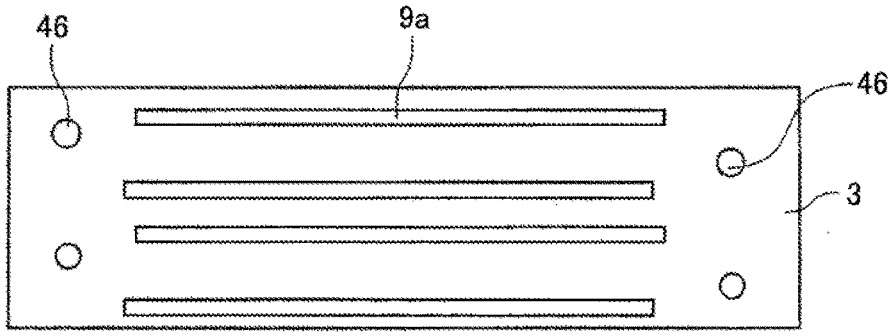
FIG. 18 is a plan view of a diaphragm member which serves as an illustration of a third embodiment of the present invention.
Figure 19:
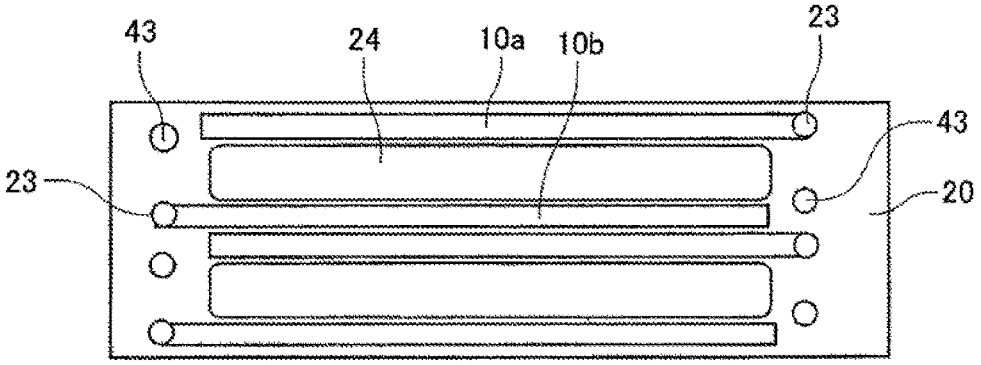
FIG. 19 is a plan view of a frame member which serves as an illustration of the third embodiment of the present invention.

Next, the third embodiment of the present invention will be described referring to FIG. 18 and FIG. 19. FIG. 18 is a plan view of a diaphragm member which serves as an illustration of the third embodiment of the present invention. FIG. 19 is a plan view of a frame member which serves as an illustration of the third embodiment of the present invention.

In the present embodiment, the common liquid chambers 10*a* and 10*b* corresponding to respective nozzle lines are independent. The liquid is supplied to each of the common liquid chambers 10*a* and 10*b* from the corresponding supplying port 23 disposed at a single end of the nozzle line.

In the third embodiment, the length of the head in the longitudinal direction can be made shorter than the first embodiment.

Figure 20:
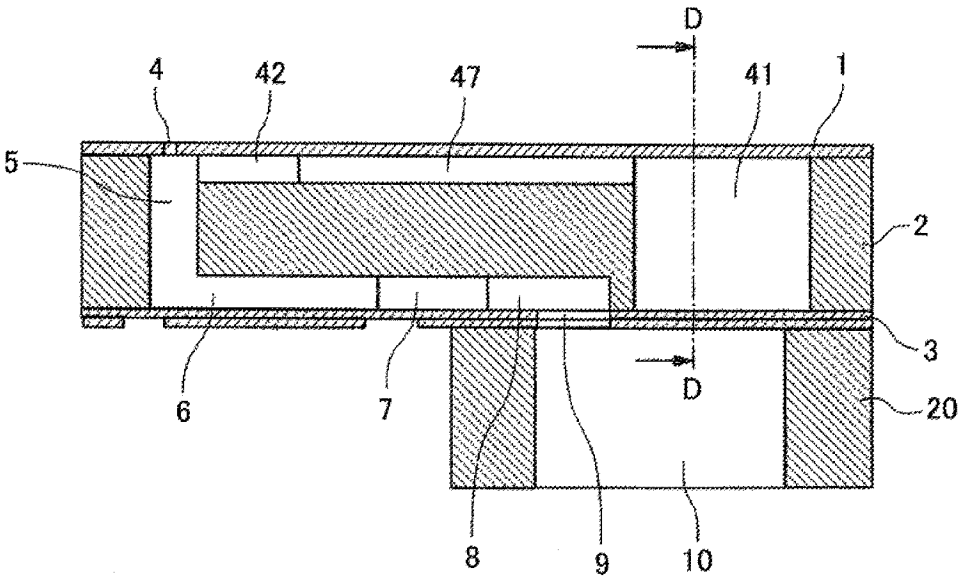
FIG. 20 is a cross-sectional view which serves as an illustration of a fourth embodiment of the present invention.
Figure 21:
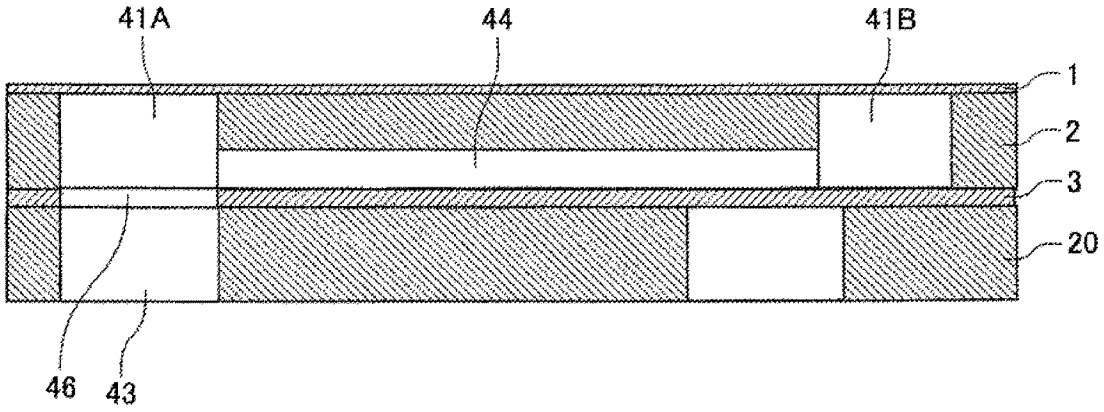
FIG. 21 is a cross-sectional view corresponding to a D-D line in FIG. 20 which serves as an illustration of the fourth embodiment of the present invention.
Figure 22:
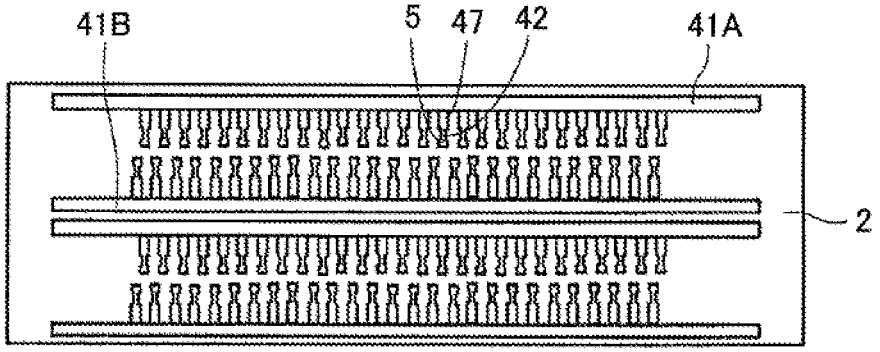
FIG. 22 is a plan view of a nozzle plate side of a channel plate which serves as an illustration of the fourth embodiment of the present invention.
Figure 23:
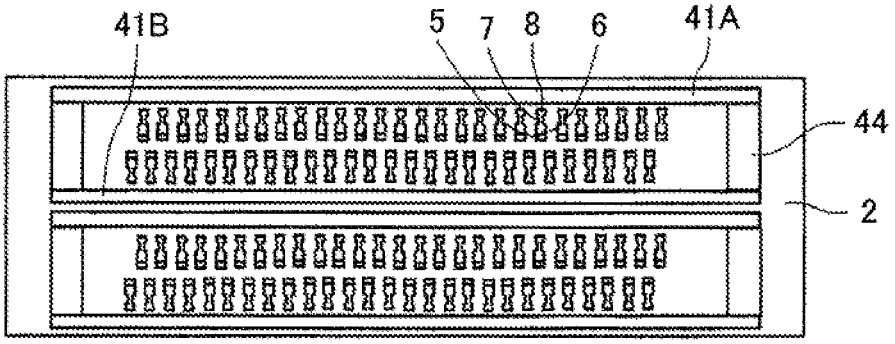
FIG. 23 is a plan view of a diaphragm member side of a channel plate which serves as an illustration of the fourth embodiment of the present invention.

Next, the fourth embodiment of the present invention will be described referring to FIG. 20 through FIG. 23. FIG. 20 is a cross-sectional view which serves as an illustration of the fourth embodiment of the present invention. FIG. 21 is a cross-sectional view corresponding to a D-D line in FIG. 20 which serves as an illustration of the fourth embodiment of the present invention. FIG. 22 is a plan view of a nozzle plate side of a channel plate 2 which serves as an illustration of the fourth embodiment of the present invention. FIG. 23 is a plan view of a diaphragm member side of the channel plate 2 which serves as an illustration of the fourth embodiment of the present invention.

In the channel plate 2, there are through-groove portions which form the circulation channels 41, groove portions which form channels 47 including the circulation resistance portions 42, and groove portions which form the bridging channels 44. Further, in the channel plate 2, there are groove portions which form the individual liquid chambers 6, the fluid resistance portions 7, and the liquid introduction portions 8, and through holes which form the channels 5.

Here, the channel plate 2 is formed of a silicon substrate, the through-groove portions which form the circulation channels 41 and through holes which form the channels 5 are formed by full etching used for penetrating through in the thickness direction; and groove portions which form the individual liquid chambers 6, the fluid resistance portions 7 and the liquid introduction portions 8 and groove portions which form the bridging channels 44 are formed by half etching.

In the present embodiment, while the bridging channels 44 are disposed at the same position (position included in the circulation channel) as the circulation channels 41 in the thickness direction of the channel plate 2, the channel cross-sectional area of the bridging channels 44 is smaller than the channel cross-sectional area of the circulation channels 41.

In the fourth embodiment, the channel plate can be formed with a simple configuration, the height (height in the thickness direction of the circulation channel member) of the circulation channel 41 can be secured, the channel cross-sectional area of the circulation channels 41 can be made larger, and the pressure loss can be reduced.

Figure 24:
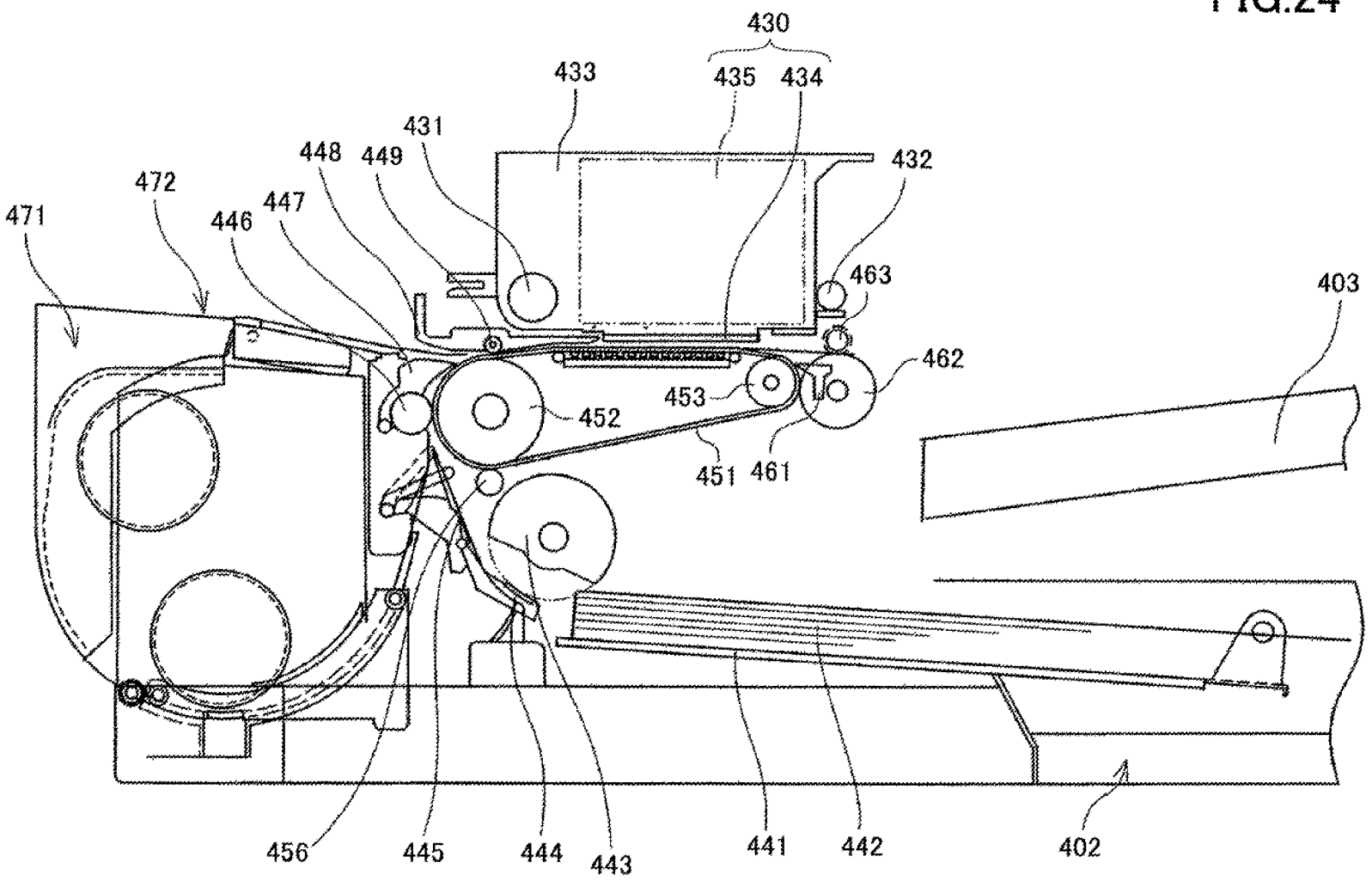
FIG. 24 is a side view of a mechanical section of an example of an apparatus for ejecting liquid including a liquid ejection unit according to an embodiment of the present invention.
Figure 25:
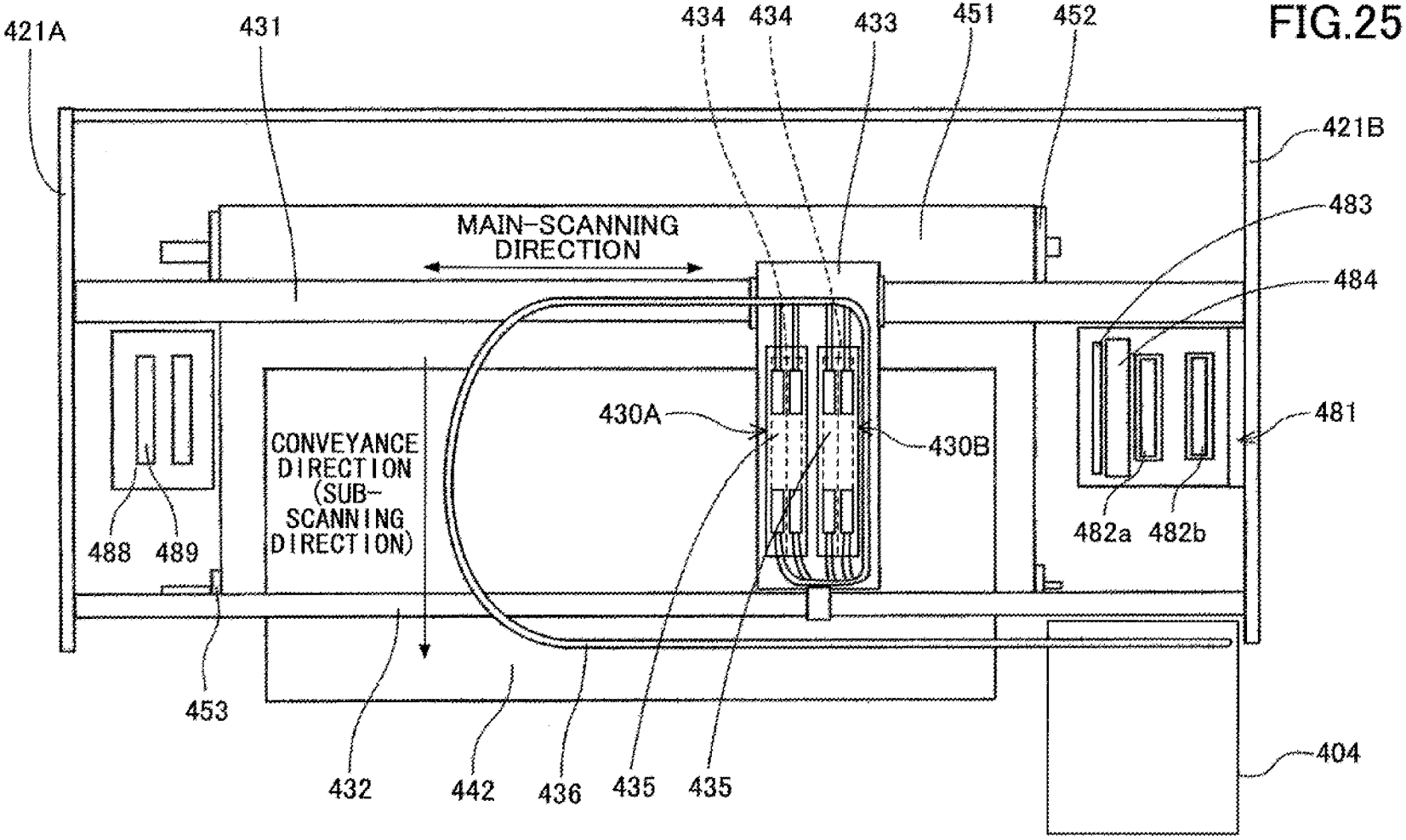
FIG. 25 is a plan view of a main section of the mechanical section.

Next, an example of an apparatus for ejecting liquid including a liquid ejection unit according to the embodiments will be described referring to FIG. 24 and FIG. 25. FIG. 24 is a side view of a mechanical section of an apparatus for ejecting liquid including a liquid ejection unit according to an embodiment of the present invention. FIG. 25 is a plan view of a main section of the mechanical section.

The apparatus for ejecting liquid is a serial type image forming apparatus. A carriage 433 is supported by a main-guidance rod 431 and a sub-guidance rod 432 which are guidance members bridging laterally between left and right side plates 421A and 421B. The carriage 433 can be reciprocated in the main-scanning direction (direction indicated by arrows in the figure).

The carriage 433 includes two liquid ejection units 430 (430A, 430B) according to the embodiments, in which liquid ejection heads 434 are integrated. In the liquid ejection head 434, there are nozzle lines including a plurality of nozzles disposed in the sub-scanning direction orthogonal to the main-scanning direction. The liquid ejection head 434 is installed having the liquid ejection direction facing downward.

Here, the liquid ejection head 434 includes two nozzle lines. Further, one of the nozzle lines of the liquid ejection head 434 of the liquid ejection unit 430A ejects black (K) liquid and the other of the nozzle lines of the liquid ejection head 434 of the liquid ejection unit 430A ejects cyan (C) liquid.

Further, one of the nozzle lines of the liquid ejection head 434 of the liquid ejection unit 430B ejects magenta (M) liquid and the other of the nozzle lines of the liquid ejection head 434 of the liquid ejection unit 430B ejects yellow (Y) liquid.

Here, it should be noted that four colors of liquid are ejected by using two liquid ejection heads, but, by having four nozzle lines in one liquid ejection head, it is possible to eject four colors of liquid from one liquid ejection head.

The apparatus body includes a supplying-and-circulating mechanism 404. The supplying-and-circulating mechanism 404 supplies and circulates the liquid stored outside of the liquid ejection unit 430 for the liquid ejection unit 430. It should be noted that in the present example, the supplying-and-circulating mechanism 404 includes a supplying tank, a circulating tank, a compressor, a vacuum pump, a liquid sending pump, a regulator (R), and the like. Further, a supplying pressure sensor is disposed between the supplying tank and the liquid ejection unit 430 and is connected to a side of a supplying channel connected to the supplying port 23 of the liquid ejection unit 430. A circulation pressure sensor is disposed between the liquid ejection unit 430 and the circulation tank and is connected to a side of the circulation channel connected to the circulation port 43 of the liquid ejection unit 430.

On the other hand, the apparatus includes, as a paper feeding unit for feeding paper 442 stacked on a paper stacking portion (pressure plate) 441 of a paper feeding tray 402, a half-moon-shaped roller (paper-feeding roller) 443 and a separating pad 444 disposed opposite to the paper-feeding roller 443, the half-moon-shaped roller 443 and the separating pad 444 being used for separating and conveying sheets of paper 442 one by one from the paper stacking portion 441.

Further, the apparatus includes a guide 445, a counter roller 446, and a conveyance guide member 447 which are used for conveying the fed paper 442 and providing guidance for the paper 442, and includes a pressing member 448 including a tip-pressure roller 449. Further, the apparatus includes a conveyance belt 451 which is a conveyance means for attracting the conveyed paper 442 and conveying the attracted paper 442 to a position opposite to the liquid ejection head 434 of the liquid ejection unit 430.

Here, the conveyance belt 451 is an endless belt wound around the conveyance roller 452 and a tension roller 453, and rotates in the belt conveyance direction (sub-scanning direction). Further, here, an electrostatic conveyance belt is used as the conveyance belt 451, which conveyance belt is charged by a charging roller 456 as a charging means. It should be noted that a conveyance belt which holds paper by air suction may also be used as the conveyance belt 451. Further, as the conveyance means, a conveyance belt may not be used, but a means for conveyance using two rollers may be used.

In the downstream side of the tension roller 453 around which the conveyance belt 451 is wound, there are a separation claw 461 used for separating the paper 442 from the conveyance belt 451, paper ejection rollers 462 and 463, and a paper ejection tray 403 under the paper ejection roller 462.

Further, a double-side unit 471 is removably attached to the rear portion of the apparatus body. The double-side unit 471 takes the paper 442 returned by reverse rotation of the conveyance belt 451 and turns over the returned paper 442, and feeds the paper 442 to a position between the counter roller 446 and the conveyance belt 451. Further, the upper surface of the double-side unit 471 is used as a manual feed tray 472.

Further, in a non-printing area of one side of the main-scanning direction of the carriage 433, there is a maintenance-and-recovery mechanism 481 used for maintaining and recovering the states of the nozzles of the liquid ejection heads 434 of the liquid ejection units 430A and 430B.

The maintenance-and-recovery mechanism 481 includes caps 482*a* and 482*b* for capping nozzle surfaces of the liquid ejection heads 434. Further, the maintenance-and-recovery mechanism 481 includes a blade member 483 for wiping nozzle surfaces. Further, the maintenance-and-recovery mechanism 481 includes, for example, a blank ejection receiver 484 which is used for receiving thickened liquid ejected in a blank ejection (idle ejection). In the blank ejection, the thickened liquid is ejected, which does not contribute to forming an image.

Further, in a non-printing area of the other side of the main-scanning direction of the carriage 433, there is a blank ejection receiver 488 which is used for receiving liquid when the blank ejection is performed during image forming. The blank ejection receiver 488 includes an opening portion 489, or the like, along the nozzle line direction of the liquid ejection heads 434.

In the image forming apparatus, sheets of paper 442 to be conveyed are separated one by one from the paper feeding tray 402. A sheet of paper 442 is conveyed in a substantially vertical direction, guided by the guide 445, nipped between the conveyance belt 451 and the counter roller 446, and conveyed. Further, the sheet of paper 442, a tip of which being guided by a conveyance guide 437, is pressed against the conveyance belt 451 by a tip pressure roller 449, and thus, the conveyance direction is converted approximately 90 degrees.

Further, when the sheet of paper 442 is conveyed onto the charged conveyance belt 451, the sheet of paper 442 is attracted to the conveyance belt 451 and conveyed in the sub-scanning direction by the circular movement of the conveyance belt 451.

Here, while the carriage 433 is being moved, the liquid ejection heads 434 of the liquid ejection units 430A and 430B are driven according to an image signal, and one line amount of an image is recorded by having liquid ejected onto the sheet of paper 442 at a stop. Further, after having a predetermined amount of the sheet of paper 442 conveyed, image forming for the next line is performed. When a recording complete signal is received, or a signal is received indicating that the end of the sheet of paper 442 has reached the recording area, the recording operation is completed and the sheet of paper 442 is ejected onto the paper ejection tray 403.

As described above, in the image forming apparatus which includes liquid ejection heads or liquid ejection head units according to the present embodiment, high-quality images can be formed in a stable manner.

In the present application, "apparatus for ejecting liquid" means an apparatus which can eject liquid onto something on which liquid can be attached.

"An apparatus for ejecting liquid" can include, not only a portion which ejects liquid, but also a means which is related to supplying, conveying and ejecting something on which the liquid is attached, and further include an apparatus which is referred to as a preprocessing apparatus or a post-processing apparatus, etc.

Further, "an apparatus for ejecting liquid" may include an apparatus which is referred to as a conventional recording apparatus, a printing apparatus, an image forming apparatus, a liquid droplet ejection apparatus, a liquid ejection apparatus, a process liquid application apparatus, a three-dimensional image forming apparatus.

Further, "an apparatus for ejecting liquid" is not limited to an apparatus in which meaningful images such as characters or graphics are visualized by the liquid which is attached to something capable of attaching the liquid. For example, an apparatus may be included in which patterns having no meaning are formed, or a three-dimensional image is formed.

It should be noted that "something on which liquid can be attached" means something on which liquid can be attached even temporarily. Further, when an alternative term such as paper, medium, recording medium, recording sheet, recording paper, or powder layer, is used in place of the term "something on which liquid can be attached", the alternative term includes, unless otherwise limited, all of "something on which liquid can be attached".

Further, material of "something on which liquid can be attached" include paper, string, fiber, cloth, towel, leather, metal, plastic, glass, wood, ceramic, as long as it is something on which liquid can be attached even temporarily.

Further, "liquid" includes ink, process liquid, DNA sample, resist, pattern material, binder, or the like.

Further, "an apparatus for ejecting liquid" includes, unless otherwise limited, both a serial type apparatus in which a liquid ejection head is moved and a line type apparatus in which a liquid ejection head is not moved.

Further, "a liquid ejection unit" means something in which a part for ejecting liquid is integrated. For example, "a liquid ejection unit" includes a unit in which a supplying-and-circulating mechanism, a carriage, a supplying mechanism, a maintenance mechanism, and a main-scanning movement mechanism are arbitrarily combined with a liquid ejection head.

For example, "a liquid ejection unit" includes a unit in which a liquid ejection head and a supplying-and-circulating mechanism described in the embodiments are integrated, a unit in which a liquid ejection head and a carriage is integrated, and a unit in which a liquid ejection head, a supplying-and-circulating mechanism, and a carriage are integrated.

Further, "a liquid ejection unit" includes a unit in which a filter unit (which forms a filter member and a distribution channel as described above) is added to the above liquid ejection unit.

Further, "a liquid ejection unit" includes a unit in which a liquid ejection head and a maintenance mechanism are integrated, a unit in which a liquid ejection head, a maintenance mechanism, and a main-scanning movement mechanism are integrated, a unit in which a liquid ejection head, a main-scanning movement mechanism, and a supplying mechanism are integrated, and the like.

The above main-scanning movement mechanism includes a carriage and a guide member for guiding the carriage, or a drive source and a carriage movement mechanism combined with the above carriage and the guide member. The maintenance mechanism is any combination of two or more of a cap, a wiper member, a suction means in communication with the cap such as a suction pump, and a blank ejection receiver.

Further, "a liquid ejection unit" includes the mechanism portion described in the embodiment from which mechanism portion a mechanism for conveying "something on which liquid can be attached" is removed.

Further, a pressure generation means used by the "liquid ejection head" is not limited. For example, other than the piezoelectric actuator described in the above embodiment, a thermal actuator in which an electro-thermal conversion element such as a heating resistor is used, a static actuator including a diaphragm and an opposite electrode may be used.

Further, in the terminology of the present application, "image forming", "recording", "printing", "print", "imaging" are synonyms.

The present application is based on and claims the benefit of priority of Japanese Priority Application No. 2014-266869 filed on Dec. 27, 2014, the entire contents of which are hereby incorporated herein by reference.

What is claimed is:

1. A liquid ejection head comprising:

at least two nozzle lines, each including a plurality of nozzles arranged in a nozzle line direction, for ejecting liquid;

a plurality of individual liquid chambers configured to be in communication with corresponding nozzles of the nozzle lines; and at least two circulation channels corresponding to the respective nozzle lines, configured to be in communication with the individual liquid chambers, wherein the at least two circulation channels are in communication with each other through a bridging channel disposed in a direction intersecting the nozzle line direction, and wherein the bridging channel and the circulation channels are connected to each other in a thickness direction of a member which forms the bridging channel and the circulation channels, the member including the bridging channel and the circulation channel includes plural layers disposed one on another in the thickness direction, and said at least two circulation channels are formed in a circulation channel layer, amongst the plural layers, which is different than, and distinct from, a bridging channel layer in which the bridging channel is formed.

2. The liquid ejection head according to claim 1, wherein the bridging channel and the circulation channel are disposed in such a way that a central axis of the bridging channel and a central axis of the circulation channel cross each other from different respective ones of the layers in the thickness direction, the central axis of the bridging channel going through a center of a channel cross-section of the bridging channel, and the central axis of the circulation channel going through a center of a channel cross-section of the circulation channel.

3. The liquid ejection head according to claim 1, further comprising:

a common liquid chamber configured to supply liquid to the individual liquid chambers of the nozzle lines;

a supplying port configured to be in communication with the common liquid chamber; and a circulation port configured to be in communication with the bridging channel;

wherein the supplying port and the circulation port are disposed at an end of the nozzle lines.

4. The liquid ejection head according to claim 1, further comprising:

at least two common liquid chambers corresponding to the nozzle lines, configured to supply liquid to the individual liquid chambers, wherein the at least two common liquid chambers are in communication with each other, and wherein supplying ports configured to be in communication with the at least two common liquid chambers are disposed at both ends of the nozzle lines.

5. The liquid ejection head according to claim 1, wherein the member including the bridging channel and the circulation channel is formed by laminating a plurality of layer members.

6. A liquid ejection unit comprising the liquid ejection head according to claim 1.

7. An apparatus comprising the liquid ejection head according claim 1.

8. The liquid ejection head according to claim 1, wherein the thickness direction corresponds to a direction in which liquid is ejected.

9. The liquid ejection head according to claim 1, wherein the member including the bridging channel and the circulation channel is formed by laminating a plurality of layer members one on another in a laminating direction corresponding to the thickness direction.

10. The liquid ejection head according to claim 1, wherein a coupling surface of the bridging channel layer contacts a coupling surface of the circulation channel layer, to couple the bridging channel to the circulation channel, and wherein each of the coupling surface of the bridging channel layer and the coupling surface of the circulation channel layer is orthogonal to the thickness direction.

11. The liquid ejection head according to claim 10, wherein the coupling surface of the bridging channel layer includes an opening portion, and the coupling surface of the circulation channel layer includes an opening portion, and wherein the bridging channel and the circulation channel are coupled to each other through (i) the opening portion of the coupling surface of the bridging channel layer and (ii) the opening portion of the coupling surface of the circulation channel layer.

12. A liquid ejection head comprising:

at least two nozzle lines, each including a plurality of nozzles arranged in a nozzle line direction, for ejecting liquid;

a plurality of individual liquid chambers configured to be in communication with corresponding nozzles of the nozzle lines; and at least two circulation channels corresponding to the respective nozzle lines, configured to be in communication with the individual liquid chambers, wherein the at least two circulation channels are in communication with each other through a bridging channel disposed in a direction intersecting the nozzle line direction, and wherein the bridging channel and the circulation channels are connected to each other in a thickness direction of a member which forms the bridging channel and the circulation channels, and the bridging channel and the circulation channels are arranged with the bridging channel overlapping the circulation channel when viewed from the thickness direction.

13. The liquid ejection head according to claim 12, wherein the bridging channel and the circulation channel are disposed in such a way that a central axis of the bridging channel and a central axis of the circulation channel cross each other from different respective ones of the layers in the thickness direction, the central axis of the bridging channel going through a center of a channel cross-section of the bridging channel, and the central axis of the circulation channel going through a center of a channel cross-section of the circulation channel.

14. The liquid ejection head according to claim 12, further comprising:

a common liquid chamber configured to supply liquid to the individual liquid chambers of the nozzle lines;

a supplying port configured to be in communication with the common liquid chamber; and a circulation port configured to be in communication with the bridging channel;

wherein the supplying port and the circulation port are disposed at an end of the nozzle lines.

15. The liquid ejection head according to claim 12, further comprising:

at least two common liquid chambers corresponding to the nozzle lines, configured to supply liquid to the individual liquid chambers, wherein the at least two common liquid chambers are in communication with each other, and wherein supplying ports configured to be in communication with the at least two common liquid chambers are disposed at both ends of the nozzle lines.

16. A liquid ejection unit comprising the liquid ejection head according to claim 12.

17. An apparatus comprising the liquid ejection head according claim 12.

* * * * *